United States Patent [19]

Hillyard

[11] 4,132,969

[45] Jan. 2, 1979

[54] IGNITION COILS

[75] Inventor: Peter T. Hillyard, Solihull, England

[73] Assignee: Lucas Industries Limited, Birmingham, England

[21] Appl. No.: 798,979

[22] Filed: May 20, 1977

[30] Foreign Application Priority Data

Jun. 8, 1976 [GB] United Kingdom ..... 23585/76

[51] Int. Cl.[2] ..... H01F 27/04

[52] U.S. Cl. ..... 336/94; 174/17 LF; 174/18; 336/107

[58] Field of Search ..... 336/105, 107, 92, 90, 336/94, 192; 174/17.07, 18, 17 LF; 29/602 R, 606

[56] References Cited

U.S. PATENT DOCUMENTS

| | | | |
|---|---|---|---|
| 2,327,784 | 8/1943 | Hartzell | 336/107 X |
| 2,512,796 | 6/1950 | Hartzell | 336/107 X |
| 3,437,966 | 4/1969 | Tolley | 336/92 X |
| 3,546,647 | 12/1970 | Roddy et al. | 336/92 |
| 4,035,751 | 7/1977 | Walthew | 336/107 |

FOREIGN PATENT DOCUMENTS

| | | | |
|---|---|---|---|
| 1296631 | 11/1972 | United Kingdom | 336/107 |

*Primary Examiner*—Thomas J. Kozma

*Attorney, Agent, or Firm*—Ladas, Parry, Von Gehr, Goldsmith & Deschamps

[57] ABSTRACT

An ignition coil wherein the high tension terminal carried in a bore in the cap of the coil is movable relative to the cap. The terminal acts as a valve member in the bore and is movable between a position wherein the bore is closed and a position wherein the bore is open. The bore can be used as the means whereby oil is introduced into the casing of the coil if the coil is to be oil filled.

14 Claims, 3 Drawing Figures

IGNITION COILS

This invention relates to ignition coils for use in internal combustion engine spark ignition systems.

An ignition coil according to the invention includes a hollow casing housing the core and the primary and secondary windings of the coil, the casing including, at one end, an electrically insulating cap supporting the high tension output terminal of the coil, said high tension terminal being received in a bore in said cap for movement relative thereto between a first position wherein the terminal is in sealing engagement with the wall of the bore, and a second position wherein there is established communication between the exterior and the interior of the casing by way of said bore.

Desirably said terminal is resiliently biassed into said first position.

Preferably said terminal is resiliently biassed lengthwise of the bore to co-operate with a circumferential shoulder forming part of the wall of said bore, to seal the bore.

Preferably, the terminal is resiliently biassed by an electrically conductive compression spring which serves also to complete an electrical connection between the core of the ignition coil and the terminal.

Conveniently said terminal is supported within said cap by way of a screw thread connection whereby said terminal can be moved between said first and second positions by appropriate rotation of said terminal relative to said cap.

Preferably said terminal is in screw thread engagement with a spring held against rotation relative to the cap.

Desirably the arrangement is such that when the terminal is in said first position the supporting spring is fully collpased and acts as a solid element.

Preferably the terminal is provided with a tool engaging means whereby a tool can be engaged with the terminal to effect rotation of the terminal.

Desirably a resiliently deformable sealing ring defines part of the wall of the bore, the terminal abutting the sealing ring in said first position.

Conveniently the terminal includes a peripheral flange which co-operates with the wall of the bore to effect sealing of the bore.

Desirably the terminal is cup-shaped and is arranged to receive, in use, a mating plug terminal.

Preferably the casing is oil filled.

The invention further resides in a method of filling an ignition coil, as defined in the preceding paragraphs, with oil the method including the steps of evacuating the casing to a predetermined pressure value via said bore, with said terminal in said second position, introducing oil into the evacuated casing via said bore and effecting movement of the terminal to its first position to seal the bore.

Preferably intermediate the steps of evacuation and filling with oil via said bore the method includes the steps of effecting movement of the terminal to said first position to seal the bore, moving the ignition coil from an evacutating station to an oil filling station and moving said terminal to re-establish communication with the casing interior via the bore to permit oil to enter the casing.

One example of the invention is illustrated in the accompanying drawings wherein.

Figure 1:
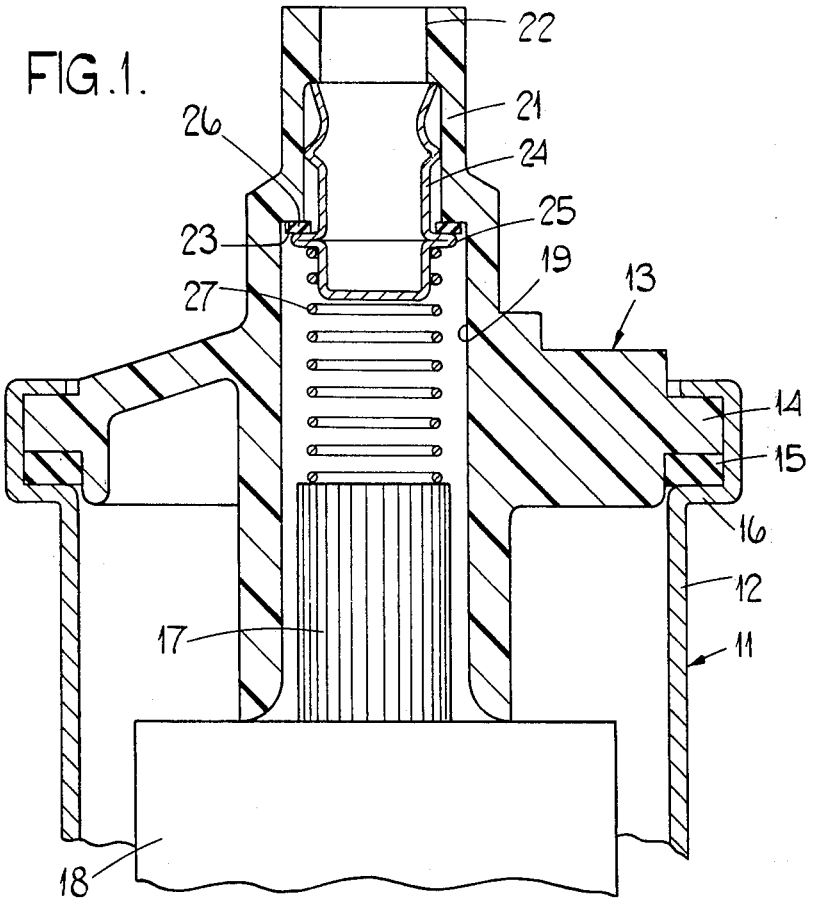
FIG. 1 is a diagrammatic sectional view of part of an ignition coil.

Referring first to FIG. 1 of the drawings, the ignition coil includes a casing 11 comprising a deep drawn metal can 12 and a moulded synthetic resin cap 13. The can 12 is closed at one end by an integral base, and closed at its other end by the cap 13, the open end of the can 12 being deformed around a peripheral flange 14 of the cap with an annular rubber, sealing member 15 trapped between one face of the flange 14 and a shoulder 16 of the can 12.

Housed within the casing 11 is the laminated soft iron core 17 and the primary and the secondary windings 18 of the ignition coil. The core 17 and windings 18 are of conventional form, the windings 18 being wound on a former through which the core 17 extends. At its end remote from the cap 13 the core is seated in a glass, or phenolic resin support member which abuts the integral base of the can 12. The opposite end of the core 17 extends into a through bore 19 of the cap 13.

The cap 13 carries low-tension electrical terminals (not shown) whereby electrical connections are made to the primary winding of the coil. The cap further includes an integral chimney 21 through which the bore 19 extends, the portion 22 of the bore 19 within the chimney 21 being of reduced diameter by comparison with the remainder of the bore 19. A radially outwardly extending peripheral shoulder 23 is defined at the junction of the portion 22 of the bore 19 with the remainder of the bore.

Disposed within the bore 19 and movable lengthwise within the bore is a cup-shaped terminal member 24 formed from aluminium. The member 24 extends into the portion 22 of the bore 19 and is formed with a peripheral, radially outwardly extending flange 25 the diameter of which is in excess of the diameter of the portion 22 of the bore 19 but less than the diameter of the remainder of the bore 19. Thus the flange 25 overlies the shoulder 23. An annular rubber sealing member is interposed between the flange 25 and the shoulder 23 and a helical compression spring acting between the flange 25 and the core 17 urges the member 24 lengthwise of the bore 19 so that the sealing sealing member 26 is trapped between the flange 25 and the shoulder 23 thus sealing the bore 19.

The open end of the terminal member 25 is flared outwardly and the portion 22 of the bore is internally stepped so that the open flared end of the member 24 is received beneath the step in the portion 22 of the bore 19. It should be noted that the dimensions of the member 24 and the bore portion 22 are such that the open flared end of the member 24 does not abut the step, movement of the member 24 towards the step under the action of the spring 27 being limited by abutment of the flange 25 with the sealing member 26 and the sealing member 26 with the shoulder 23.

Figure 2:
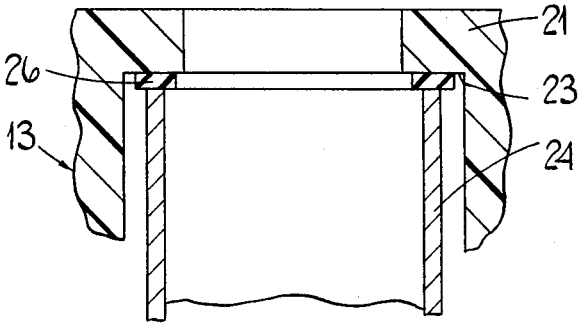
FIG. 2 is a fragmentary sectional view of a modification of the arrangement shown in FIG. 1 to an enlarged scale.

In the modification shown in FIG. 2 the cup-shaped terminal member 24 is plain, and does not have the external flange 25. Instead the free, open end of the member 24 traps an annular rubber sealing member 26 against an internal shoulder 23 adjacent the open end of the chimney 21, the spring in this instance acting between the base of the member 24 and the core. In all other respects the modification is similar to the construction described with reference to FIG. 1.

In use, the terminal member 24 is engaged by a mating plug-type terminal at the end of a high-tension electrical lead. The casing 11 of the ignition coil is filled with oil to enhance the internal electrical insulation of the coil, and also to improve cooling of the windings of the coil. The force exerted on the terminal member 24 by the spring 27 is not only sufficient to ensure an oil tight seal at the member 26 but also is sufficient to prevent movement of the member 24 relative to the chimney 21 during normal engagement of the plug type terminal therein. It will be understood that it is desirable that the plug type terminal is a relatively tight fit within the member 24 to ensure a good electrical connection. Thus a significant amount of force must be exterted to interengage the plug type terminal and the terminal member 24. The spring 27 is sufficiently strong to prevent the seal being broken during such normal engagement.

It will be understood that during assembly of the ignition coil the member 24 must be introduced into the bore 19 from the wider end thereof, and thus the member 24, the member 26 and the spring 27 must be positioned relative to one another within the bore 19 before the cap 13 is assembled to the can 12. After assembly of the ignition coil the casing 11 is filled with oil in the following manner. A vacuum line is connected to the chimney 21 by means of a union which includes a peg whereby the terminal 24 is depressed in the bore 19 against the action of the spring 27. This movement of the terminal member 24 relative to the cap is movement of the terminal 24 from a first position wherein the bore 19 is closed to a second position, breaking the seal between the flange 25 and the shoulder 23 to establish communication by way of the bore 19 between the interior of the casing 11 and the vacuum line in the second position. The casing 11 is then evacuated down to a predetermined pressure which is chosen in accordance with the volume of oil to be introduced into the casing. Thereafter a valve in the vacuum line union is operated to break communication between the vacuum line and the chimney 21 and in its place to establish communication between an oil line and the chimney 21. Thus oil flows from the oil line through the union and into the chimney 21. From the bore portion 22 the oil flows around the member 24 and between the flange 25 and the shoulder 23 into the bore 19, and from the bore 19 into the evacuated interior of the casing 12. If ncessary grooves can be provided on the wall of the bore portion 22 to enhance the flow of oil between the wall of the bore and the member 24. Alternatively, the member 24 could be pierced between its free end and the sealing face of the flange 25 again to facilitate the inflow of oil.

When a sufficient quantity of oil has been introduced into the casing 11, the flow of oil is cut off at the union and the union is removed from the chimney 21 thus permitting the spring 27 to return the member 24 to its rest position sealing the bore 19.

It will be understood that it may well prove desirable not to use a common union for both vacuum extraction and supply of oil, since this could lead to oil retained in the union being drawn back to the vacuum pump unless specific precautions are taken to avoid this. The provision of the seal by means of the spring biassed member 24 affords a filling sequence wherein the problem is obviated. Initially a vacuum line is coupled to the chimney 21 in exactly the manner described above, the member 24 being depressed and the casing 11 being evacuated to the desired pressure level. Thereafter, the vacuum line is removed completely permitting the member 24 to be returned to its sealing position so that the bore 19 is sealed maintaining the reduced pressure level in the casing 11. Thereafter, a totally separate oil line is connected to the chimney 21, the union of the oil line including a peg, which as the union is connected to the chimney, displaces the member 24 against the action of the spring 27 to establish communication between the oil line and the interior of the casing 11. Again after the required quantity of oil has been introduced into the casing the flow of oil is cut off, and the union is removed thus permitting the member 24 to be returned to its sealing position by the spring 27.

Figure 3:
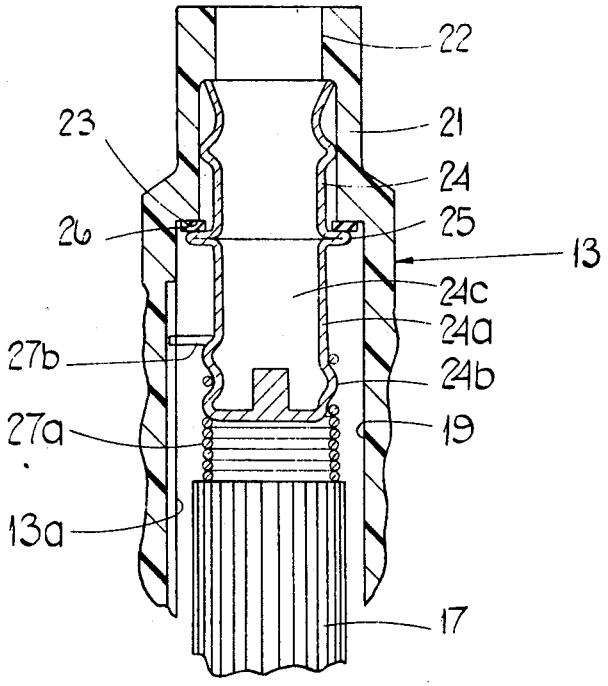
FIG. 3 is a view similar to FIG. 1 of a further modification.

A further modification is illustrated in FIG. 3 which shows the modification applied to the construction shown in FIG. 1. It is to be understood that if desired the modification can be applied to the construction shown in FIG. 2.

The innermost end of the terminal 24 is extended at *24a* and defines an external screw thread *24b*. A spring *27a* is in screw threaded engagement with the thread *24a* and has an extension *27b* which engages in an elongate slot *13a* in the cap 13 to prevent rotation of the spring *27a* relative to the cap 13. At its end remote from the terminal 24 the spring *27a* abuts the core 17. The base of the terminal 24 is formed with an integral projection *24c* which is shaped to permit engagement therewith of a driving tool whereby the terminal can be rotated relative to the cap 13. Thus the projection *24c* can be of non-circular cross-section or can be formed with a transverse or cruciform slot as with a bore of non-circular cross-section.

It will be understood that rotation of the terminal 24 relative to the spring *27a* will result in axial movement of the terminal relative to the cap. Moreover the terminal can be rotated relative to the spring to achieve a situation wherein the flange 25 abuts the rubber seal at the shoulder 23 and the spring *27a* is fully collapsed, that is to say has its adjacent convolutions in contact and is therefore acting as a solid element. In this situation the terminal cannot be depressed to open the bore 22 since the spring *27a* is incapable of further compression and in order to open the bore 22 the terminal must be rotated to unscrew it away from the shoulder 23. Similarly the terminal can be unscrewed relative to the shoulder 23 sufficiently far that the spring *27a* is incapable of moving the flange 25 into abutment with the seal at the shoulder 23 and so in this situation the bore will remain open until the terminal is rotated to screw it back towards the shoulders 23. Thus at the extremes of movement of the terminal 24 the spring *27a* can be considered merely as a screw thread on the cap 13, and could if desired, be replaced by a screw threaded insert fixed relative to the cap 13.

The operation of the modification shown in FIG. 3 during evacuation and illing is identical to that described above with reference to FIGS. 1 and 2 with the exception that the union or unions for the vacuum and oil supplies must incorporate means whereby the terminal 24 can be rotated relative to the cap 13 in the appropriate direction. For example the union or unions may include a motorized Allen key which engages in an appropriate recess in the projection *24c* upon engagement of the union with the chimney 21.

The arrangements described above have considerable advantage over the conventional arrangements wherein the high-tension terminal is an insert secured in the chimney of the cap by a screw or a rivet passing through the base of the terminal and into a transverse partition wall of the chimney. For example the oil filling sequence cannot conveniently be separated from the evacuating sequence with the prior art arrangement since if the vacuum union is removed from the chimney in the prior art arrangement then the casing merely refills with ambient atmosphere through the opening in the partition wall of the chimney. Furthermore, an efficient seal is achieved with the above described arrangement in a relatively simple manner, whereas in the prior art arrangement it is quite difficult to achieve an effective seal. In practice a sealing ring is usually interposed between the partition wall of the chimney and the base of the terminal member, the sealing ring being compressed by the screw or rivet which secures the terminal member to the partition wall of the chimney.

In the embodiments described above the high tension terminal is a socket type terminal. It is to be understood that if desired a pin type terminal could be utilised. A pin type terminal would have an annular flange equivalent to the sealing flange of the socket terminal, from which the terminal pin would extend towards the outer end of the chimney.

I claim:

1. An ignition coil including a hollow casing housing the core and the primary and secondary windings of the coil, the casing including, at one end, an electrically insulating cap supporting the high tension output terminal of the coil, said cap having extending therethrough a bore communicating with the interior of the casing, and the wall of the bore defining a radially extending shoulder presented inwardly of the casing, said high tension terminal being movable received in said bore, and being movable inwardly of the casing, from a first, rest position, wherein the terminal sealing engages said shoulder so sealing the casing, to a second position wherein there is established communication between the exterior and the interior of the casing by way of said bore, and means for retaining said terminal in said first, rest position.

2. An ignition coil as claimed in claim 1 wherein said terminal is resiliently biassed into said first position.

3. An ignition coil as claimed in claim 2 wherein said terminal is resiliently biassed lengthwise of the bore to co-operate with said shoulder.

4. An ignition coil as claimed in claim 2 wherein said terminal is resiliently biassed by an electrically conductive compression spring which serves also to complete an electrical connection between the core of the ignition coil and the terminal.

5. An ignition coil as claimed in claim 1 wherein said terminal is supported within said cap by way of a screw thread connection whereby said terminal can be moved between said first and second positions by appropriate rotation of said terminal relative to said cap.

6. An ignition coil as claimed in claim 5 wherein said terminal is in screw thread engagement with a spring held against rotation relative to the cap.

7. An ignition coil as claimed in claim 6 wherein when said terminal is in said first position the supporting spring is fully collapsed and acts as a solid element.

8. An ignition coil as claimed in claim 5 wherein said terminal is provided with a tool engaging means whereby a tool can be engaged with the terminal to effect rotation of the terminal.

9. An ignition coil as claimed in claim 1 wherein a resiliently deformable sealing ring defines part of the wall of the bore, the terminal abutting the sealing ring in said first position.

10. An ignition coil as claimed in claim 1 wherein said terminal includes a peripheral flange which co-operates with the wall of the bore to effect sealing of the bore.

11. An ignition coil as claimed in claim 1 wherein said terminal is cup-shaped and is arranged to receive in use, a mating plug terminal.

12. An ignition coil as claimed in claim 1 wherein the casing is oil filled.

13. A method of filling an ignition coil as claimmed in claim 1 with oil, comprising the steps of evacuating the casing to a predetermined pressure valve via said bore, with said terminal in said second position, introducing the oil into the evacuated casing via said bore and effecting movement of the terminal to its first position to seal the bore.

14. A method of claimed in claim 13 wherein intermediate the steps of evacuation and filling with oil via said bore the method includes the steps of effecting movement of the terminal to said first position to seal the bore, moving the ignition coil from an evacuating station to an oil filling station and moving said terminal to re-establish communication with the casing interior via the bore to permit oil to enter the casing.

* * * * *